US005826627A

United States Patent [19]

Seabrook et al.

[11] Patent Number: 5,826,627

[45] Date of Patent: Oct. 27, 1998

[54] COMPOSITE PAPERMAKING FABRIC WITH PAIRED WEFT BINDING YARNS

[75] Inventors: Ronald H. Seabrook, Stittsville; Dale B. Johnson, Ottawa; Derek G. Chaplin, Kanata; Rex Barrett, Peachtree, all of Canada

[73] Assignee: JWI Ltd., Kanata, Canada

[21] Appl. No.: 807,629

[22] Filed: Feb. 27, 1997

[51] Int. Cl.[6] ..... D03D 11/00; D03D 13/00

[52] U.S. Cl. ..... 139/383 A; 162/903; 442/203

[58] Field of Search ..... 139/383 A; 162/903; 442/203

[56] References Cited

U.S. PATENT DOCUMENTS

| | | | |
|---|---|---|---|
| 4,501,303 | 2/1985 | Osterberg | 139/383 A |
| 4,605,585 | 8/1986 | Johansson | 139/383 A |
| 4,815,499 | 3/1989 | Johnson | 139/383 A |
| 5,152,326 | 10/1992 | Vohringer | 139/383 A |
| 5,518,042 | 5/1996 | Wilson | 139/383 A |
| 5,564,475 | 10/1996 | Wright | 139/383 A |

*Primary Examiner*—Andy Falik
*Attorney, Agent, or Firm*—Robert A. Wilkes

[57] ABSTRACT

A composite forming fabric in which the woven paper and machine side layers are interconnected by pairs of intrinsic weft binder yarns which interweave with the paper side layer to occupy an unbroken weft path. Each member interweaves sequentially with the warps of the paper side layer and with at least one warp of the machine side layer. Each part of the unbroken weft path is separated from adjacent parts by at least one paper side layer warp yarn. The unbroken weft path is the same, or different, to the weft path of the immediately adjacent paper side layer weft yarns. This arrangement overcomes the paper side layer surface imperfections, which cause an unacceptable level of marking, hitherto associated with the use of intrinsic weft binder yarns in composite fabrics.

23 Claims, 7 Drawing Sheets

COMPOSITE PAPERMAKING FABRIC WITH PAIRED WEFT BINDING YARNS

FIELD OF THE INVENTION

The present invention relates to woven composite forming fabrics for use in papermaking machines. As used herein, the term "composite forming fabric" refers to a forming fabric comprising two complete and independent weave structures, comprising a paper side layer and a machine side layer, that are interconnected by binder yarns, substantially as described by Johnson in U.S. Pat. No. 4,815,499. Within such a fabric, since both the paper side layer and the machine side layer are commonly woven to different, but related, repeating patterns, there are three possible pattern repeats: within only the paper side layer, within only the machine side layer, and for the complete woven structure. Each of these three pattern repeats are of significance to this invention. In this invention, the composite forming fabric comprises a machine side layer interconnected to a paper side layer by means of intrinsic weft binder yarns.

BACKGROUND OF THE INVENTION

In composite forming fabrics that include two essentially separate woven structures, the paper side layer is typically a woven single layer which provides amongst other things a minimum of fabric mark, adequate drainage of liquid from the incipient paper web, and maximum support for the fibers in the pulp slurry. The machine side layer is also typically a single layer weave, which should be tough and durable, provide a measure of dimensional stability to the composite fabric, so as to be resistant to stretching and narrowing, as well as impart sufficient stiffness to prevent the edges of the fabric from curling. It is also known to use woven double layer structures for each of the paper side layer and the machine side layer.

The two layers of a composite forming fabric are typically interconnected in one of two ways: additional binder yarns, or intrinsic binder yarns. The chosen yarns can be warps or wefts. This invention is concerned with a composite fabric in which intrinsic weft binder yarns are used.

Intrinsic weft binder yarns are weft yarns that contribute to the structure of the paper side layer paper side surface, and also serve to bind together the paper side layer and machine side layer. Additional weft binder yarns do not contribute to the fundamental weave structure of the paper side surface of the paper side layer, and are interwoven between the paper side and machine side layers simply to bind them together. In practise, the paths of selected weft yarns are modified so that they pass through both layers thereby interconnecting them. Generally, additional weft binder yarns are used commercially for binding the two layers together because they are less likely to cause discontinuities in the paper side layer paper side surface, and are preferred in commercial practise for minimising paper side layer paper surface dimpling. Examples of composite forming fabrics woven using intrinsic binder yarns are described by Osterberg, U.S. Pat. No. 4,501,303, Givin, U.S. Pat. No. 5,052,448 and Chiu, U.S. Pat. No. 5,219,004.

Although the use of both intrinsic warp and intrinsic weft binder yarns is taught by the prior art, intrinsic warp binder yarns are not often used for interconnecting the layers of a composite forming fabric. Intrinsic warp binder yarns invariably give rise to large variations in the uniformity of the surface of the paper side layer, which result in unacceptable marking of the paper. Typically, large depressions known as dimples are formed.

Intrinsic weft binders cause less paper side dimpling, but generally still give variations in cross-machine direction mesh uniformity that cause an unacceptable level of marking in most grades of paper. In U.S. Pat. No. 4,501,303 Osterberg suggests interconnecting the layers of a composite forming fabric by using pairs of intrinsic warp or weft binder yarns. However, this patent does not teach how to use intrinsic weft binder yarns, and there does not appear to have been successful commercial use of this invention due to unresolved problems related to paper side layer uniformity.

SUMMARY OF THE INVENTION

The present invention seeks to overcome these deficiencies by seeking to provide a composite forming fabric comprising in combination a paper side layer having a paper side surface, a machine side layer, and a plurality of pairs of first and second members which together comprise pairs of intrinsic weft binder yarns which bind together the paper side layer and the machine side layer, wherein:

(i) each of the paper side layer and the machine side layer comprise warp yarns and weft yarns woven to a repeating pattern;

(ii) in the paper side surface of the paper side layer the repeating pattern provides a weft yarn path in which the weft yarns float over 1, 2 or 3 consecutive paper side layer warp yarns;

(iii) the pairs of intrinsic weft binder yarns together occupy one unbroken weft path in the paper side layer weave pattern; and (iv) in the paper side layer, the unbroken weft path occupied by a pair of intrinsic weft binder yarns is the same as, or different to, the weft path occupied by the immediately adjacent paper side layer weft yarns;

and wherein the pairs of intrinsic weft binder yarns are woven such that:

(a) in a first segment of the unbroken weft path:
  (1) the first member of the pair interweaves with a first group of warps to occupy a first part of the unbroken weft path in the paper side surface of the paper side layer;
  (2) the first member of the pair floats over 1, 2 or 3 consecutive paper side layer warp yarns; and
  (3) the second member of the pair interweaves with at least one warp yarn in the machine side layer;

(b) in an immediately following second segment of the unbroken weft path:
  (1) the second member of the pair interweaves with a second group of warps to occupy a second part of the unbroken weft path in the paper side surface of the paper side layer;
  (2) the second member of the pair floats over 1, 2 or 3 consecutive paper side layer warp yarns; and
  (3) the first member of the pair interweaves with at least one warp yarn in the machine side layer;

(c) the first and second segments are of equal or unequal length;

(d) the unbroken weft path in the paper side surface of the paper side layer occupied in turn by the first and second member of each pair of intrinsic weft binder yarns in the paper side layer has a single repeat pattern; and (e) each succeeding part of the unbroken weft path in the paper side surface of the paper side layer occupied in sequence by the first and second members of a pair of intrinsic weft binder yarns is separated in the paper side surface by at least one paper side layer warp yarn.

In a preferred embodiment the present invention seeks to provide a composite forming fabric comprising in combination a paper side layer, a machine side layer, each of which comprise warp yarns and weft yarns woven to a repeating pattern, and a plurality of pairs of first and second members which together comprise pairs of intrinsic weft binder yarns, and which occupy one unbroken weft path in the paper side layer weave pattern, wherein the pairs of intrinsic weft binder yarns are woven such that:

(a) in a first segment of the unbroken weft path:
  (i) the first member of the pair interweaves with a first group of warps to provide a first part of the unbroken weft path in the paper side surface of the paper side layer that is substantially identical to that of its adjacent paper side layer wefts, and
  (ii) the second member of the pair interweaves with at least one warp yarn in the machine side layer so as to bind the paper and machine side layers together;

(b) in an immediately following second segment of the unbroken weft path:
  (i) the second member of the pair interweaves with a second group of warps to occupy a second part of the unbroken weft path in the paper side surface of the paper side layer that is substantially identical to that of its adjacent paper side layer wefts, and
  (ii) the first member of the pair interweaves with at least one warp yarn in the machine side layer so as to bind the paper and machine side layers together;

(c) the first and second segments are the same length;

(d) the unbroken weft path in the paper side surface of the paper side layer occupied in turn by the first and second member of each pair of intrinsic weft binder yarns in the paper side layer has a single repeat pattern; and (e) each succeeding part of the unbroken weft path in the paper side surface of the paper side layer occupied in sequence by the first and second members of a pair of intrinsic weft binder yarns is separated in the paper side surface by one paper side layer warp yarn.

Preferably each succeeding part of the unbroken weft path in the paper side surface of the paper side layer occupied in sequence by the first and second members of a pair of intrinsic weft binder yarns is separated in the paper side surface by either one paper side layer warp yarn, or by two paper side layer warp yarns.

Preferably, the locations at which the members of the intrinsic weft binder yarn pairs interweave with the machine side layer warp yarns are regularly spaced along the machine side layer warps in the machine side layer weave structure, and all of the intrinsic weft binder yarns have the same number of paper side layer wefts between them.

DETAILED DESCRIPTION OF THE INVENTION

In the context of this invention four terms are important and have the following meanings.

As used herein, the term "segment" refers to a length of the unbroken weft path in the paper side layer occupied by one intrinsic weft binder yarn.

The associated term "segment length" refers to a distance which is expressed as a number of paper side layer warp yarns. Each weft binder yarn rises past a first warp into the paper side layer, interweaves with at least one paper side layer warp, and then drops down into the machine side layer before a second warp. The segment length is then the number of paper side layer warps with which the weft binder yarn interweaves, plus the first warp, and plus any further paper side layer warps in between the second warp and the next first warp of the succeeding segment. Thus if there is only one intervening warp and a weft binder yarn interweaves with N warp yarns, then the segment length is (N+1). If there are two intervening warps, the segment length is (N+2).

As used herein, the term "unbroken weft path" refers to the portion of the complete pattern repeat path of each of the binder yarns which is located in the paper side layer, and therefore more or less corresponds to that portion of the intrinsic weft binder yarn path in which each binder yarn interlaces in sequence with the paper side layer warp yarns. Each weft binder yarn when occupying the unbroken weft path is more or less visible in the paper side surface of the paper side layer in the complete forming fabric. The term "unbroken" in this definition is meant to require that in the completed fabric there are no apparent gaps or overlaps in the intrinsic binder wefts in the paper side surface of the paper side layer in the completed fabric.

As used herein, the term "registration" refers to the relationship within the weave pattern repeat between specified weft yarns. If the specified weft yarns are woven so that the weave pattern visible on the paper side surface continues across them, then they are in registration with each other. Alternatively, even though the specified weft yarns are woven to the same pattern, if the specified weft yarns are woven so that the visible weave pattern does not continue across them, then they are not in registration with each other.

In the composite forming fabric of this invention, the paths of each of the intrinsic weft binder yarns are interchanged between successive segments of the unbroken weft path in the paper side layer weave. At each interchange point the weft binder yarn previously interweaving with the machine side layer rises to the paper side layer, while the other member of the pair drops down from the paper side layer and interweaves with the machine side layer. These weft binder yarns do not pass by each other in the paper side surface of the paper side layer, but rather beneath this level: at no point in the unbroken weft path in the fabrics of this invention are the two members of any weft binder pair located in a side by side relationship that is visible on the paper side surface of the fabric. At each interchange point the weft binder yarn rising from the machine side layer and the weft binder yarn dropping down from the paper side layer are separated by at least one paper side layer warp; the two members of the weft binder pair pass by each other in a plane immediately beneath the paper side layer warps. Thus although the paths of each of the two binder yarns in the paper side layer appear to be the same and provide a continuous unbroken weft path with a single pattern repeat when the paper side layer surface is viewed from above, the actual weave paths of each member of a pair of weft binder yarns within the composite fabric can be quite different.

Furthermore, the repeat pattern of the unbroken weft path need not be the same as the repeat pattern of the immediately adjacent ordinary non-binding weft yarns. In this context there are several possibilities:

(a) both the weft yarns and the unbroken weft path are woven to the same pattern, and are in registration with each other;

(b) both of the adjacent weft yarns are woven to the same pattern and in registration with each other, and the unbroken weft path is woven to a different pattern;

(c) both the adjacent weft yarns are woven to the same pattern but not in registration with each other, and the unbroken weft path is woven to the same pattern and in registration with one of the adjacent weft yarns; and (d) both the adjacent weft yarns are woven to the same pattern but not in registration with each other, and the unbroken weft path is woven to a different pattern.

In (a) the unbroken weft path is visually almost undiscernible in the paper side layer surface, whilst in each of the others a level of randomness is introduced into the fabric paper side layer surface. Further, in (a) both the wefts and the unbroken weft path are woven to the same pattern, whilst in the others there are two patterns: that of the wefts, and that of the unbroken weft path.

Although the pair members are woven to provide the unbroken weft path in the paper side layer, each member of the pair is interwoven between the separate woven layers in accordance with a repeating pattern that provides a path that is different from that of the wefts in both the machine side layer and the paper side layer. The pair members each alternately interlace with the paper side layer and machine side layer in accordance with a repeating weave pattern in which the paths of the pair members interchange at the ends of the segments in the unbroken weft path.

Whilst there has to be a relationship between the combined lengths of the segments and the number of sheds involved in creating the composite fabric, since the visible weave pattern for the unbroken weft path need not be the same as that of either of the adjacent wefts, the unbroken weft path can introduce a level of apparent disorder, even what appears visually to be a level of randomness, into the weave design of the paper side surface of the paper side layer. In the past such disorder in the paper side surface has been considered to be a disadvantage, and therefore such weave patterns have generally been avoided. It was believed that weave patterns with such a level of disorder would lead to marking of the paper and problematic drainage of the incipient paper web. It is now known that this is not so: for certain applications at least a forming fabric woven to such a pattern can result in better finished paper, for example as regards its printability.

Thus, in the composite fabrics of this invention, the unbroken weft paths of the intrinsic weft binder yarn pairs may be chosen from at least the following options.

Case (1): the segment lengths are equal, and the pair members are interwoven according to a repeating pattern that is in registration with that of the paper side layer weave.

Case (2): the segment lengths are equal, and the pair members are interwoven according to a repeating pattern that is not in registration with that of the paper side layer weave.

Case (3): the segment lengths are unequal, and the pair members are interwoven according to a repeating pattern that is in registration with that of the paper side layer weave.

Case (4): the segment lengths are unequal, and the pair members are interwoven according to a repeating pattern that is not in registration with that of the paper side layer weave.

Each of these Cases is discussed below; in this discussion, S refers to a number of sheds.

Case (1).

In this case the paths of both binder yarns in the paper side layer are the same. The segments are off-set in each pair by the constant segment length in the paper side layer so that the paths of each member of the pair are symmetric with respect to one another. Since the unbroken weft path of the binder yarns is in registration with the wefts of the paper side layer, there is no visually discernible disorder in the paper side layer pattern. One pair of intrinsic binder wefts provides effectively another paper side layer weft.

Consequently, the segment length is related to the paper side layer pattern repeat length (in terms of the number of paper side layer warps involved) by an integral number ratio. There is only one path for the intrinsic binder yarns, and the length of the pattern repeat in the unbroken weft path is the segment length. This occurs in fabrics woven according to 16, 24 or 32 shed patterns, for example, where the quotient of S/4 is an even integer, such as 4, 6 or 8.

Case (2)

In this case, the intrinsic weft binder pairs are interwoven according to a weave pattern which provides an unbroken weft path that is not in registration with the paper side layer weave wefts, and need not be woven to the same weave pattern as those wefts. This creates a visually discernible disruption, a level of disorder, in the paper side surface pattern of the paper side layer.

This occurs in composite fabrics that are woven in 16, 24 or 32 sheds, as above, wherein the quotient of S/4 is an even integer, such as 4 or 6.

Case (3)

In this case, since the segment lengths are unequal, the paths of each of the members of a pair of intrinsic weft binder yarns are not the same, and the number of paper side layer warp yarns between successive interchanges of the pair members is dissimilar from one interchange to the next.

This occurs in composite fabrics that are woven in 12, 20 or 28 sheds, where the quotient of S/4 is an odd integer such as 3, 5 or 7.

Case (4)

In this case the unbroken weft path occupied by the weft binder yarns is woven to a different pattern than the other wefts in the paper side layer. As is noted for Case (2) above, this creates a visually discernible disruption, a level of disorder, in the paper side surface pattern of the paper side layer.

This occurs in composite fabrics that are woven in 12, 20 or 28 sheds, as above, and the quotient of S/4 is an odd integer such as 3, 5 or 7.

Within each of these Cases there is a further option which is most relevant to Cases (2) and (4). For in addition to the unbroken weft path being woven to a different pattern to the paper side layer wefts, the paper side layer wefts do not have to be in registration with each other, ignoring the intervening unbroken weft path. This provides yet another way in which some randomness can be introduced into the paper side surface of the paper side layer.

It is a requirement of this invention that there be at least one paper side layer warp yarn at each interchange point. From this it follows that the interchange locations where the members pass by each other are in a plane close to and beneath the intervening warp yarn or yarns. Regardless of segment length, it is usually possible to offset the interchange locations, defining the ends of the segments in the machine direction of the composite fabric, so that successive pairs of intrinsic weft binder yarns preferably are located so that they interlace with the machine side layer warps at a constant distance apart along the machine side layer warps.

The number of machine side layer warp yarn interweaving sites in one repeat of the intrinsic weft binder yarn pairs is a function of the number of sheds in which the composite forming fabric is woven. Thus, each of the binder yarn pair members interlaces once with every S/4 machine side layer warp yarn in each repeat of the binder yarn weave pattern. For example, in a composite fabric woven according to a 12 shed pattern, every 3rd machine side layer warp yarn will be interlaced by one of the two pair members; in a 16 shed fabric, a pair member will interlace every 4th machine side layer warp; in a 20 shed fabric, the interlacing will occur every 5th warp, while in a 24 shed fabric, one binder yarn pair member will interlace every 6th machine side warp yarn.

The composite forming fabrics of this invention are comprised of two woven structures interconnected by means of intrinsic weft binder yarns. These fabrics are generally woven according to 12-, 16-, 20- or 24-shed, or higher, weave patterns.

Preferably, the weave construction of the paper side layer of a fabric of this invention is selected from the group consisting of, but not limited to: a plain weave, 2/1 twill, 3/1 twill, 3/1 broken twill, a so-called 2×2 basket weave, or other pattern in which the weft yarns float over no more than 3 warp yarns.

Preferably, the weave construction of the machine side layer woven structure is selected from the group consisting of, but not limited to, four-shed twill weaves, four-shed broken twill weaves, four-shed/eight repeat satin weaves, 5-shed satin weave, eight-shed/eight repeat satin weaves having differing warp and weft float lengths within one repeat of the weave pattern, and single layer n×2n weave patterns, such as are described by Barrett in U.S. Pat. No. 5,544,678 in which the warp yarns form two distinct floats of unequal length, and the weft yarns form floats of equal or unequal length on the machine side surface. One example of such an n×2n weave pattern is the 6×12 weave pattern disclosed in the '678 patent.

Preferably, the weave construction of the unbroken weft path for the intrinsic weft binder yarns corresponds to a weft path in a weave construction selected from the group consisting of, but not limited to: a plain weave, 2/1 twill, 3/1 twill, 2×2 basket weave, or other pattern in which the weft yarns float over no more than 3 warp yarns, and with at most two intervening paper side layer warps at the interchange points at the segment ends.

Preferably, the composite forming fabric is woven to have the following general characteristics:

1) the number of warp yarns in the paper side layer is equal to, and is preferably greater than the number of warp yarns in the machine side layer; (i.e.: 1:1, 3:2)
2) the ratio of the number of paper side layer weft yarns, including allowing for pairs of intrinsic weft binder yarns, to the number of weft yarns in the machine side layer, is at least 3:2, and preferably is a higher value, such as 3:1, 4:1, or 5:1;
3) the location at which the intrinsic weft binder yarns interweave with the paper side layer warp yarns and machine side layer warp yarns should be such that the distance along any selected warp between two successive sites is the same for all intrinsic weft binder yarns within the weave repeat of the composite forming fabric.

We have found that the use of pairs of intrinsic weft binder yarns in composite forming fabrics appears to be governed by two criteria:

1) each of the yarn members making up each pair of intrinsic weft binder yarns must occupy some of the unbroken weft path in the paper side layer within a weave repeat for the composite fabric; and
2) the location at which the intrinsic weft binder yarns interweave with the machine side warp yarns should be such that the distance along any selected machine side layer warp between two successive interweave sites is the same for all intrinsic weft binder yarns within the weave repeat of the composite fabric.

Of these, the first is essential, whilst the second is desirable.

Not all of the weaves that can be used in combination in a composite forming fabric for the paper side layer and the machine side layer can satisfy these criteria. For the paper side layer it is relatively simple to choose an appropriate repeat pattern for the unbroken weft path.

Compliance with the second criterion is more difficult. Some weaves, such as a 4-harness broken twill, are not desirable for the machine side layer weave because although criterion 1 can be met, it is not possible to satisfy criterion 2. If a 4-harness broken twill is used as the machine side layer of a composite fabric of this invention that is woven to, for example, a 4-, 8- or 12-shed pattern, the resulting fabric is not symmetrical, and has a non-uniform cross machine direction appearance since it becomes difficult to locate the intrinsic weft binder yarn pairs and still avoid problems such as dimpling. This can result in marking of the paper web which, for some paper products, may not be acceptable. However if a 20, or higher, shed arrangement is used, these difficulties can often be overcome.

Certain weave patterns that are not acceptable when woven using a low number of sheds can be satisfactory if the number of sheds is increased, because the higher number of sheds provides greater flexibility in choosing the locations where the weft binder yarns interlace the machine side layer warps. Excessive tension, and excessive crowding, in the machine side layer can be avoided, thus reducing to an acceptable level, if not eliminating, problems such as dimpling.

Typical Paper and Machine Side Weave Combinations

| Paper Side | Machine Side | Tie Pattern | Sheds |
|---|---|---|---|
| Plain weave | 1 × 3 twill<br>1 × 3 broken twill | Plain weave | 16, 24 |
| Plain weave | 1 × 4 satin | Plain weave | 20 |
| Plain weave | 6 × 12 satin | Plain weave | 24 |
| Plain weave | 1 × 3 broken twill | 1 × twill, inverted | 24 |
| 1 × 2 twill | 1 × 3 broken twill | 1 × 2 twill, inverted | 24 |
| 1 × 2 twill | 6 × 12 satin | 1 × 2 twill, inverted | 24 |
| 2 × 2 basket weave | 1 × 3 twill | Plain weave | 16 |

The composite forming fabrics of the present invention offer several advantages over prior art composite forming fabrics.

First, the diameter of the intrinsic weft binder yarns need not be less than the diameter of the other weft yarns forming the weave structure of the paper side layer, and can be the same as, or even marginally greater than, the diameter of the other paper side layer weft yarns. The factor determining just how much larger the intrinsic weft binder yarns might be is that their diameter cannot be so large as to cause marking of the incipient paper web. The larger size of the intrinsic weft binder yarns, especially when these are marginally larger than the other wefts, provides more material to be worn away by normal internal wear thereby increasing the effective service life of the composite fabric.

Second, there is no undue distortion of the paper side surface, and thus minimal, if any, marking of the paper. The pair of intrinsic weft binder yarns occupying the unbroken weft path can provide what appears from a visual standpoint to be a single paper side surface weft that is almost indiscernible from neighbouring continuous paper side layer wefts. Alternatively, it is possible to select the repeating pattern for the unbroken weft path so as to visually disrupt the regularity of the paper side surface. As the test results given below indicate, such a level of disorder rather than resulting in increased marking of the paper web by the forming fabric can improve the properties of the finished paper, for example in terms of its behaviour as a printing surface. It is also observed that such a fabric does not result in uneven drainage of the incipient paper web: the drainage characteristics do not appear in many cases to be adversely affected.

Third, the ability to use intrinsic weft binder yarns that are the same size as the other paper side layer weft yarns adds to the strength of the fabric in terms of resisting narrowing and adding to the stiffness of the fabric.

Fourth, it is now possible to utilise in a composite forming fabrics paper side layers having very high numbers of weft yarns relative to the machine side layer. If one weft binder pair is counted as one paper side layer weft yarn, then it becomes possible to create fabrics in which the ratio of the paper side layer wefts to machine side layer wefts exceeds 3:1, to values of 4:1 and even 5:1. This is an unexpected result, and was not feasible in prior art composite forming fabrics where a plain weave paper side layer was interconnected to the machine side layer structure by means of additional binder yarns, because of the excessive crowding which developed in the paper side layer weave at the points where the binder yarns and the paper side layer wefts were adjacent to one another in the weave structure. By increasing the paper side layer to machine side layer weft ratio, the composite forming fabrics of this invention are able to provide greatly improved retention, as well as increased fiber support and smoothness.

Fifth, although the composite forming fabrics of this invention can have a paper side surface with an apparent level of visual disorder in the weave structure, these fabrics also provide a very uniform paper side surface, substantially free of any dimples.

BRIEF DESCRIPTION OF THE DRAWINGS

The invention will now be described by way of reference to the Figures in which:

In FIGS. 1, 2, 3 and 7 through 12 two conventions are adopted. In part (*a*) of each Figure warps are numbered sequentially from left to right for the paper side layer followed by the machine side layer. The paths for the intrinsic weft binder yarns in both the paper side layer and the machine side layer are identified as A and B: yarn A is shown as a solid line, and yarn B as a broken line. In part (*b*) of each Figure only the paper side layer warps are shown, numbered to correspond with part (*a*), and the paper side layer weft is identified as W.

In FIGS. 1 through 3, a 16-shed weave composite fabric is shown: the paper side layer warp yarns are 1–8, the machine side layer warp yarns are 9–16.

In FIG. 1, intrinsic weft binder yarn A is:

Figure 1A:
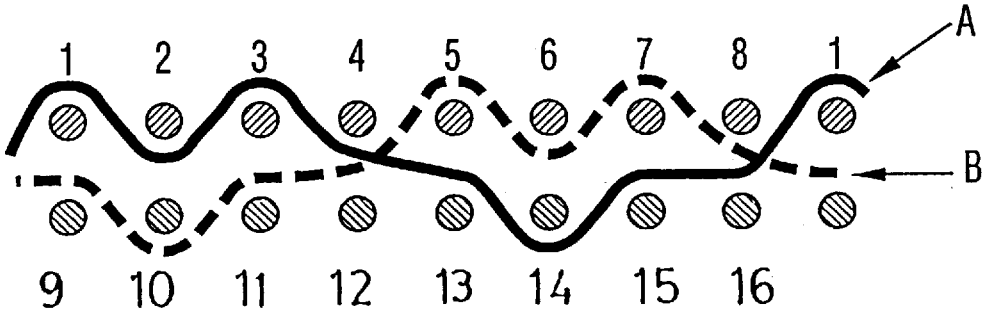
FIGS. 1(*a*), 2(*a*) and 3(*a*) are schematic cross section views of composite forming fabrics in which the segment lengths are the same, and FIGS. 1(*b*), 2(*b*) and 3(*b*) and similar cross sections showing the paper side weft path for these fabrics.

interwoven with warps 1, 2 and 3, passes beneath warp 4, passes between warps 5 and 13 between the two layers, passes beneath warp 14, passes between in sequence warps 7 and 15, 8 and 16 between the two layers, and passes over warp 1 in the next repeat to restart the paper side layer weave pattern.

Intrinsic weft binder yarn B follows the same path, but offset by 4 warps from weft A. Within the nine warp sequence shown, the wefts A and B exchange paths twice. First, in the space in between warps 4, 5, 12 and 13, weft A passes down into the machine side layer, and weft B passes upward into the paper side layer. Second, in the space defined by warps 8, 1, 16 and 9 weft B passes down into the machine side layer, and weft A passes upward into the paper side layer. Each of the intrinsic weft binder yarns A and B interweaves with a machine side layer warp, at warps 14 and 10, respectively.

Figure 1B:
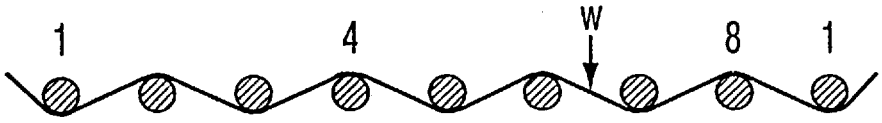

The adjacent weft yarn W in FIG. 1(*b*) is woven as a plain weave.

FIG. 1 also shows some of the fundamental features of this invention.

Since each of the intrinsic weft binder yarns A and B both interweave with four paper side layer warps, the weft binder segment lengths are the same.. Further, since the paper side layer are woven as a plain weave, their pattern repeat length is two warps, and the pattern repeat length in the unbroken weft path introduced by the intrinsic weft binder yarn pair is four warps, which is also the segment length. Consequently the ratio of the pattern repeat in the weft to the pattern repeat in the unbroken weft path is 1:2.

There is minimal, if any, discontinuity introduced into the paper side layer weave by the intrinsic weft binder yarns: as one member leaves the paper side layer the other enters it to occupy the unbroken weft path. The paper side layer is thereby provided with effectively a continuous weft interwoven with all of the warps 1 through 8.

The points where the intrinsic weft binder yarns interweave with the machine side layer are regularly spaced apart, as there are the same number of machine side layer warps between them. From this it also follows that the intrinsic weft binder yarns all have the same path, interweaving with both the paper side layer and the machine side layer, within a weave repeat of the composite forming fabric.

At each interchange point, such as in the area bounded by the warps 4, 5, 12 and 13 in FIG. 1(*a*), there is one warp in between the parts of the unbroken weft path: at this location it is warp 4. It can also be seen that the only point in which the binder yarns A and B are in a side by side relationship is below the plane of the paper side layer warps; at this location it is below warp 4. As a consequence of this, there is no point in the surface of the paper side layer in which yarns A and B are beside each other.

FIG. 1(*a*) also shows two segments, for each of A and B. In each case the segment length is 4 warps: 1–4 for A, and 5–8 for B. There is only one warp, 4 and 8, at each segment end in between the two parts of the unbroken weft path.

Figure 2A:
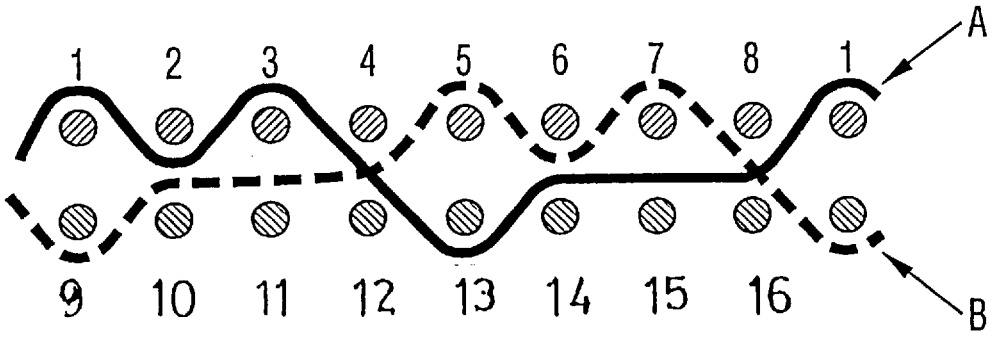
Figure 2B:
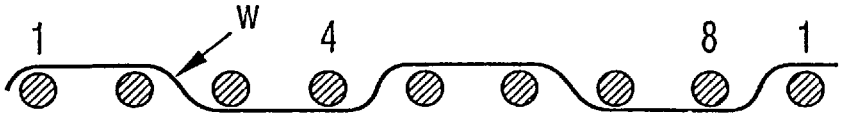

In FIGS. 2(*a*) and 3(*a*), the interweaving paths of binder wefts A and B in the paper side layer are the same. The differences are in the interweaving points into the machine side layer.

In FIG. 2(*a*) binder weft yarn B passes under warp 9, and binder weft yarn A passes under warp 13. The interweaving points are hence close to the beginning of each intrinsic weft binder yarn segment, but they are still regularly spaced apart, as there are the same number of machine side layer warps between them. This pattern could be reversed, using warps 12 and 16 as the interweaving points with the machine side layer.

Figure 3A:
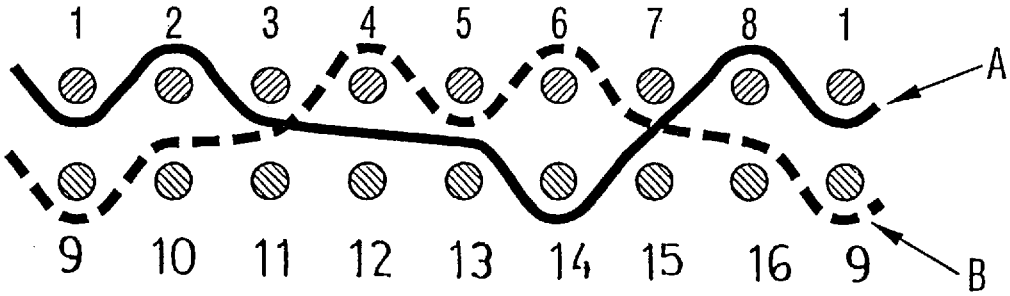
Figure 3B:
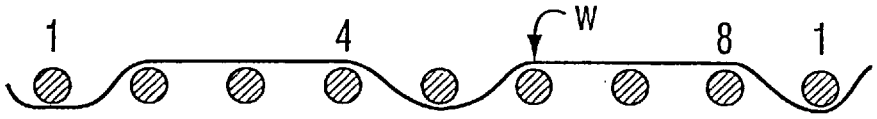

In FIG. 3(*a*) weft B passes under warp 9, as it does in FIG. 2, but weft A passes under warp 14. Consequently, the points where the intrinsic weft binder yarns interweave with the machine side layer warps are irregularly spaced, with four and two warps between them in sequence.

In FIG. 2(*b*) the adjacent weft yarn W is woven as a 2×2 "basket weave" and is not in registration with the unbroken weft path. In FIG. 3(*b*) it is woven as a 3×1 twill or broken twill.

In FIGS. 1(*a*)–2(*a*) and 3(*a*), the ratio of the number of warp yarns of the paper side layer weave to the number of warp yarns in the machine side layer weave is 1:1. This is not necessary, and it is possible to increase this ratio to 2:1 or more.

Figure 4:
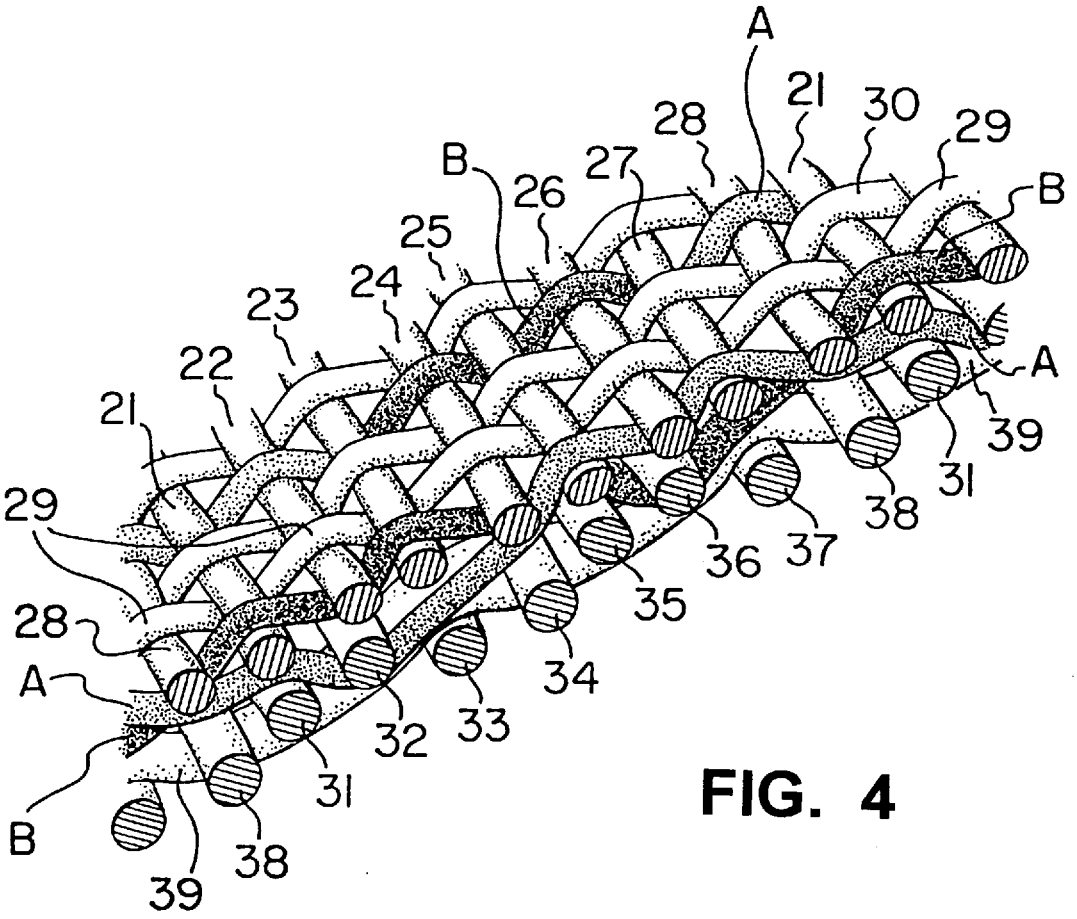
FIG. 4 is an oblique view of the edge of a composite forming fabric.

FIG. 4 shows an oblique sectioned view of a composite forming fabric, in which the paper side layer and the edge section can be seen. The paper side layer is a plain weave, and the machine side layer is a 4 shed twill weave, and the composite fabric is woven in 16 sheds. The yarns are identified as follows.

Intrinsic weft binder yarn A is shown light shaded, and intrinsic weft binder B is shown dark shaded. The paper side layer warps are 21–28, and the machine side layer warps are 31–38. Two "ordinary" paper side layer wefts are 29 and 30, and a machine side layer weft is 39.

Comparison of FIGS. 1(*a*) and 4 shows that the weave pattern for the two members of the weft binder pair A and B shown in FIG. 1 is also adopted in FIG. 4. Two further aspects of the fabric design can be seen from FIG. 4. First, the unbroken weft path of the wefts A and B within the paper side layer when taken together is the same as the adjacent paper side layer wefts 29 and 30, and the path of the machine side layer weft 39 is quite different. Second, although there are the same number of warps in each layer, those in the paper side layer are somewhat smaller than those in the machine side layer.

Figure 5:
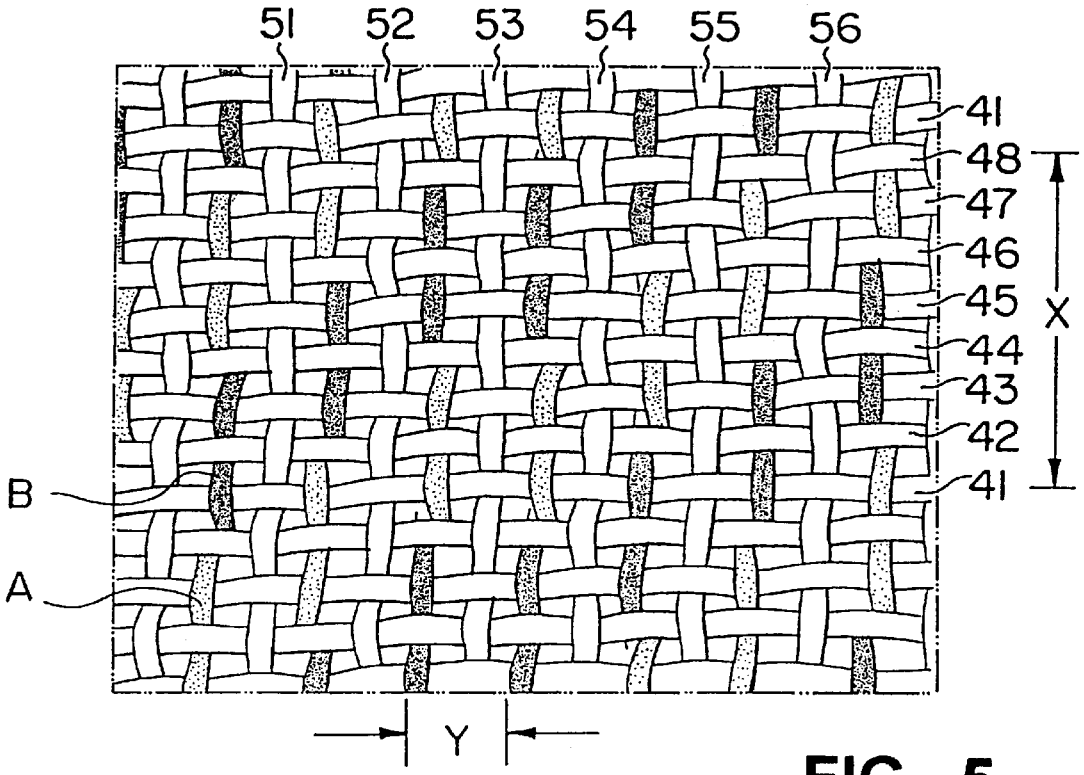
FIGS. 5 and 6 show the paper side and machine side surfaces respectively of a composite fabric.

In this fabric it can also be seen that in the paper side layer there are two wefts in between each pair of intrinsic weft binder yarns. This is not a limitation: in a plain weave such as this other combinations are possible, such as only one weft between each intrinsic weft binder yarn pair, as is shown in FIG. 5 and discussed below. Further, the unbroken weft path occupied in sequence by A and B is in registration with both of the adjacent wefts, so that the overall weave pattern is not apparently interrupted.

Figure 6:
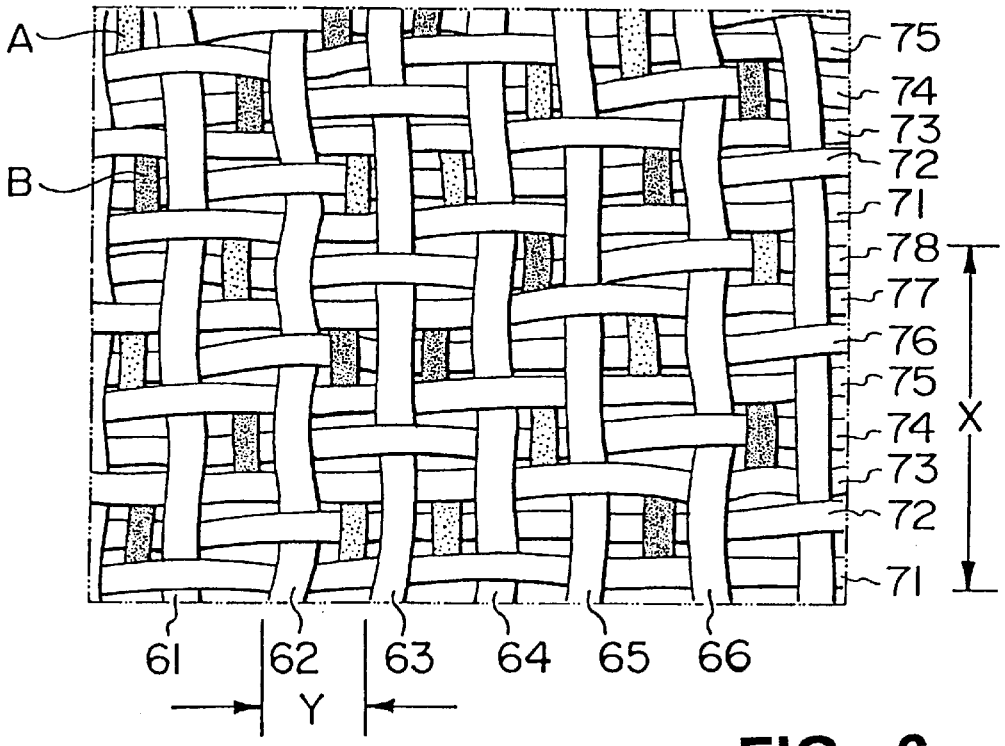

FIGS. 5 and 6 show the two faces of a composite fabric: FIG. 5 shows the paper side layer, and FIG. 6 shows the machine side layer. The paper side layer is again a plain weave, and the machine side layer is a 4 shed/8 repeat satin weave. In these Figures, the yarns are identified as follows.

Intrinsic weft binder yarn A is shown light shaded, and intrinsic weft binder B is shown dark shaded. Paper side layer wefts are 51–56, and machine side layer wefts are 61–66. Paper side layer warps are 41–48, and machine side layer warps are 71–78.

Several features of this invention are apparent from these two Figures.

The interchange points between the two members making up an intrinsic weft binder yarn pair need not be offset in the paper side layer weave pattern. In FIG. 5 for the A, B weft pairs between wefts 52, 53 and between wefts 53, 54 the segment ends are not offset, and occur at warps 44 and 48. For all of the other weft pairs A, B shown the segment ends are offset by two warps either side of each weft: for example from warp 42 to warp 44 on each side of weft 55.

In FIG. 6 the interweaving locations between the weft A, B pairs with succeeding machine side layer warps are regularly spaced, and all of the weft A, B pairs have the same path within the composite forming fabric weave. For all of the weft A, B pairs the next adjacent interweaving point is either one weft away, e.g. either side of weft 63, or four wefts away, e.g. at warps 52, 56 between wefts 62, 63. When the wefts A, B are not offset, the interweave points form a roughly square pattern as at the centre of FIG. 6, or a roughly diamond pattern elsewhere.

Comparison of FIGS. 5 and 6 shows first that the machine side layer in FIG. 6 is a much coarser weave than the paper side layer of FIG. 5. A similar difference can also be seen in FIG. 4. In the fabric shown in FIGS. 5 and 6, the yarn diameters were:

warps: paper side layer, 0.147 mm diameter, machine side layer 0.129 mm×0.190 mm;

wefts: paper side layer, 0.127 mm diameter; wefts A, B, 0.104 mm diameter; machine side layer 0.218 mm diameter.

In this fabric the intrinsic weft binder pairs are therefore somewhat smaller than the ordinary wefts. Second, although the warp counts in the two layers are the same, the weft counts are different. In each layer there are eight warps in the distance X, but whereas there are two wefts in FIG. 5 in the distance Y there is only one weft in the distance Y in FIG. 6. Hence, allowing for the fact that one weft A, B pair counts as only one weft, the weft ratio between the paper side layer in FIG. 5 and the machine side layer in FIG. 6 is 2:1.

In FIGS. 7–12 further cross sections are shown.

Figure 7A:
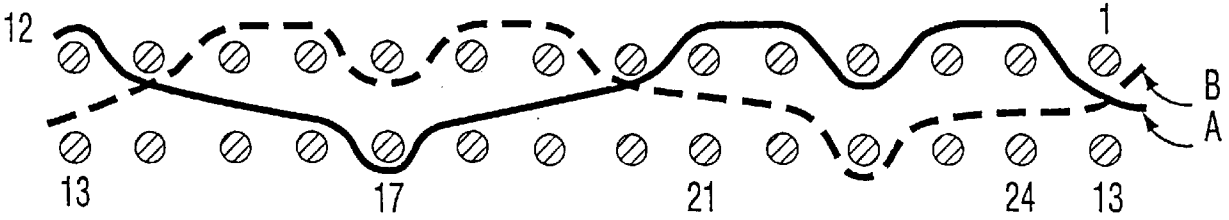
FIGS. 7 through 12 are parts of schematic cross section views of composite forming fabrics illustrating several combinations of intrinsic weft binder paths (in part (*a*) of each Figure) and paper side layer weft paths (in part (*b*) of each Figure).
Figure 7B:
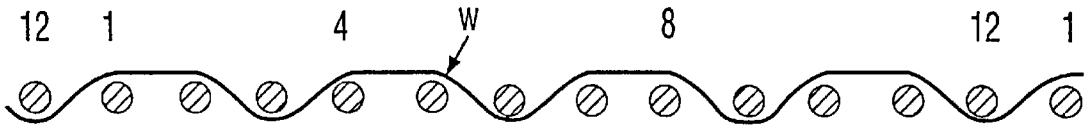

In FIG. 7(*a*) the segment lengths are equal, and in FIG. 7(*b*) both the unbroken weft path, and the weft W are woven to a 2×2 basket weave pattern. The wefts A, B are in registration with the adjacent wefts to provide a visually apparently uninterrupted pattern on the paper side face. This fabric is a 24 shed weave, and will typically use a 1×3 broken twill or a 6×12 weave (see Barrett, U.S. Pat. No. 5,544,673) as the machine side layer.

Figure 8A:
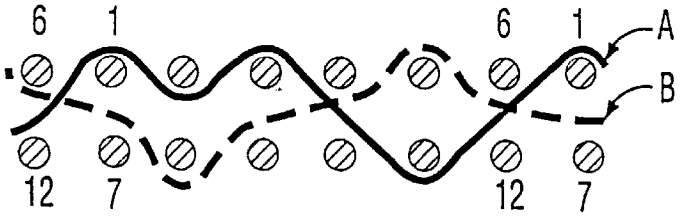
Figure 8B:
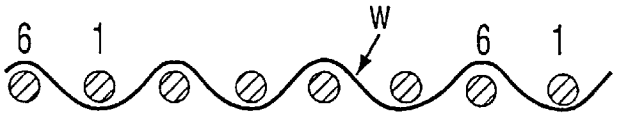

In FIG. 8(*a*) the segment lengths are unequal, having segment lengths of 4 and 2 warps. In FIG. 8(*b*) the weft W is woven to a plain weave, with the unbroken weft path in registration with the adjacent weft yarns to provide a visually apparently uninterrupted pattern on the paper side face. This fabric is a 12 shed weave, and will typically use a 1×2 3 shed twill or broken twill as the machine side layer.

Figure 9A:
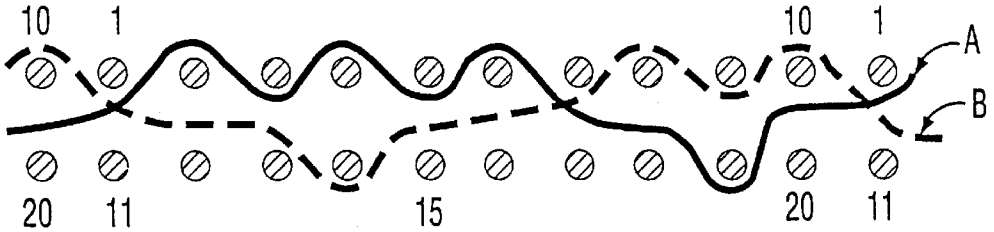
Figure 9B:
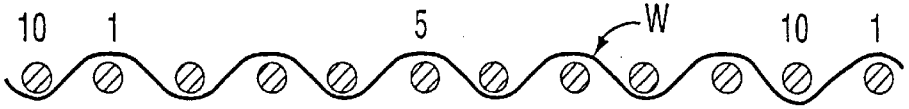

In FIG. 9(*a*) the segment lengths are unequal, having segment lengths of 6 and 4 warps. In FIG. 9(*b*) the weft W is woven to a plain weave, with the unbroken weft path in registration with the adjacent weft yarns to provide a visually apparently uninterrupted pattern on the paper side face. This fabric is a 20 shed weave, and will typically use a 1×4 twill or broken twill as the machine side layer.

Figure 10A:
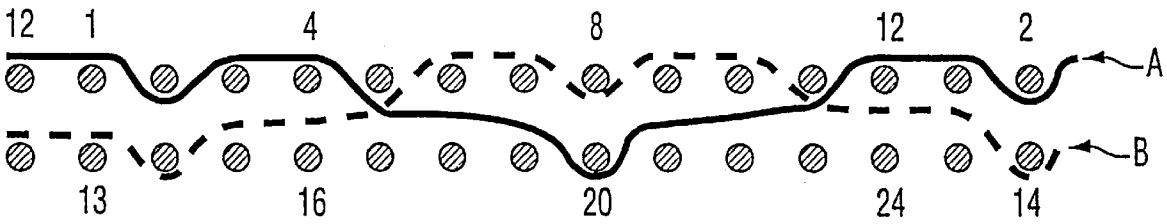
Figure 10B:
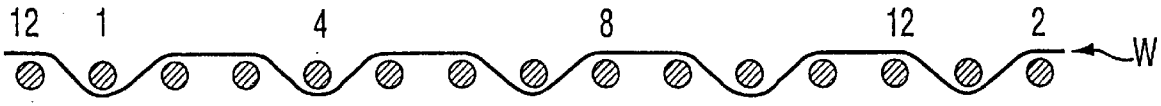

In FIG. 10(*a*) the segment lengths are equal, and both are 6 warps. The path for the weft W is shown in FIG. 10(*b*). Both the weft W and the unbroken weft path are woven as a 1×2 twill. As shown, the adjacent weft is in registration with the unbroken weft path; to maintain registration the weft on the other side of the unbroken weft path will have to pass under, for example, warp 3.

Figure 11A:
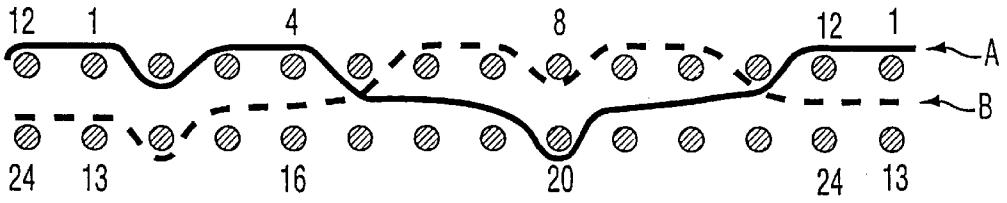
Figure 11B:
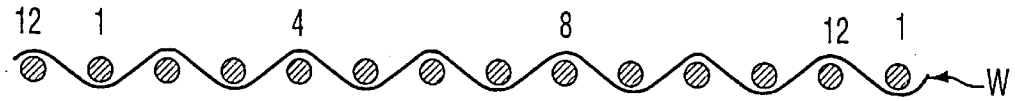

Alternatively, as shown in FIG. 11(*a*), the paper side wefts are woven as a plain weave; there is then no registration at all with the unbroken weft path shown in FIG. 11(*b*). These fabrics are 24 shed weaves, and will typically use a 1×3 broken twill or a 6×12 weave (see Barrett, U.S. Pat. No. 5,544,673) as the machine side layer.

Figure 12A:
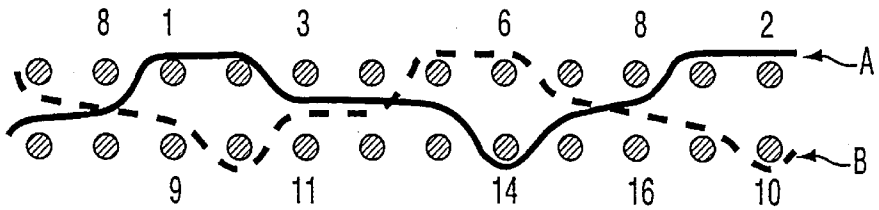
Figure 12B:
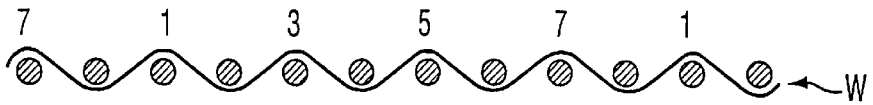

In FIG. 12(*a*) the segment lengths are equal, and both are 4 warps. In FIG. 12(*b*) the weft W is woven as a plain weave, and the unbroken weft path is woven as a 2×2 basket weave. This has two consequences: there cannot be any registration between the unbroken weft path and the adjacent wefts, and there are two warps 3, 4 and 7, 8 between the parts of the unbroken weft path at each interchange point. This fabric is a 16 shed weave, and will typically use a 1×3 broken twill as the machine side layer.

COMPARATIVE EXAMPLE

A composite forming fabric containing pairs of intrinsic weft binder yarns as the test fabric was compared to a conventional composite fabric woven using additional weft binder yarns. Both fabrics employed 0.150 mm diameter round warp yarns in the paper side layer and 0.129 mm×0.190 mm rectangular warp in the machine side layer. The weft sizes used in each fabric and the weave constructions of the paper and machine side layers are given in Table 1 below; the test fabric was woven according to FIG. 4.

TABLE 1

CONVENTIONAL FABRIC COMPARED TO PRESENT INVENTION

| YARN SIZE & WEAVE | CONVENTIONAL | TEST FABRIC |
|---|---|---|
| Paper side layer warp diameter (mm) | 0.150 | 0.150 |
| Machine side layer warp size (mm) | 0.129 × 0.190 | 0.129 × 0.190 |
| Paper side layer weft diameter (mm) | 0.140 | 0.127 |
| Intrinsic Weft Yarn diameter (mm) | n/a | 0.112 |
| Additional Weft Yarn diameter (mm) | 0.110 | n/a |
| Machine side layer weft diameter (mm) | 0.231 | 0.279 |
| Paper side layer weave | Plain | Plain |
| Machine side layer weave | 4-shed broken twill | 4-shed twill |

Table 2 provides a comparison between the properties of the two fabrics. The values given in Table 2 were obtained using standard measurement techniques.

TABLE 2

COMPARISON OF FABRIC PROPERTIES

| FABRIC PROPERTY | CONVENTIONAL FABRIC | TEST FABRIC |
|---|---|---|
| Warp yarns/cm: Paper side layer | 32 | 33 |
| Warp yarns/cm: Machine side layer | 32 | 33 |
| Weft yarns/cm: Paper side layer | 27.6 | 35.8 |
| Weft yarns/cm: Machine side layer | 18.5 | 11.8 |
| Elastic Modulus, kg/cm | 1,299 | 1,431 |
| Lateral Contraction, %/kg/cm | 0.0335 | 0.0263 |
| Thickness, mm | 0.71 | 0.752 |
| Air Permeability, $m^3/hr/m^2$ | 7,500 | 7,000 |
| Drainage Index | 32 | 39 |
| Fiber Support Index | 148 | 177 |
| Frame Length, mm | 0.22 | 0.15 |

TABLE 2-continued

COMPARISON OF FABRIC PROPERTIES

| FABRIC PROPERTY | CONVENTIONAL FABRIC | TEST FABRIC |
|---|---|---|
| MD Stiffness, grams | 2.40 | 4.40 |
| CD Stiffness, grams | 2.80 | 4.20 |

In Table 2:

"Paper side layer" means the independent weave structure comprising the side of the fabric on which the paper is formed;

"Machine side layer" means the independent weave structure comprising the side of the fabric which is in contact with the support surfaces in the forming section;

"MD" means machine direction; and

"CD" means cross machine direction.

In Table 2, it should be noted that the number of weft yarns per cm in the paper side layer of the test fabric is calculated by counting the pairs of intrinsic weft binder yarns as one yarn, not two.

From Tables 1 and 2, it is apparent that the conventional fabric and that of the test fabric are comparable with respect to paper side layer weave design, warp and weft yarn dimensions, and warp yarn counts. However, the paper side layer plain weave structure of the test fabric has a 30% higher weft yarn count than the paper side layer plain weave structure of the conventional fabric, and the machine side layer has a 36% lower weft yarn count, due to the use of relatively larger diameter weft. The ratio of the number of paper side layer weft to machine side layer weft of the test fabric is 3:1, while that of the conventional fabric is approximately 1.5:1. These features of the test fabric provide a number of additional and unexpected advantages.

First, the test fabric has a higher elastic modulus and lower lateral contraction than the conventional fabric, which is defined as the percentage reduction in width per unit of applied machine direction tension. The test fabric is 21% more resistant to narrowing, as demonstrated by the measured values of lateral contraction, and has an elastic modulus that is 10% greater. The reduction in lateral contraction in the test fabric is partly due to the use of relatively larger diameter weft in the machine side layer. The higher elastic modulus of the test fabric means that it will be more resistant to stretching than the conventional fabric.

Second, the stiffness of the test fabric is 50% higher in the CD, and 83% higher in the MD, than the conventional fabric, which increases the ability of the test fabric to lie flatter and be free of any waviness when in operation on the paper making machine.

Third, the test fabric has a high paper side layer weft yarn count (91 per cm compared to 70 per cm in the conventional fabric) which provides this fabric with a much higher Drainage Index , Fiber Support Index, and lower Frame Length than the conventional fabric. Drainage Index, Fiber Support Index, and Frame Length are all important characteristics of paper making machine forming fabrics which relate to their drainage capabilities, retention, sheet release, fabric cleanability and paper quality, especially smoothness.

Drainage Index is a dimensionless number as defined by Johnson (*Pulp & Paper Canada,* 85 (6), T167–T172 (1984)) and is a relative indicator of the ability of the fabric to drain water from the slurry presented to it on the machine. The 22% higher Drainage Index numbers of the test fabric indicate that it will provide relatively better forming fabric drainage than the conventional fabric.

Fiber Support Index (FSI), also a dimensionless number as defined by Beran (*TAPPI,* 62(4), 39 (1979)) describes the relative level of support provided by the fabric for the pulp fibers in the slurry. The 20% higher FSI of the test fabric indicates that it will provide relatively better the support for the pulp fibers in the pulp slurry, consequently resulting in improved release of the sheet from the forming fabric, and in paper sheet smoothness.

Frame Length of the fabric is the average machine direction length of the mesh openings defined by the uppermost surface of the paper side layer weave, as defined by Kufferath (*Pulp & Paper Canada,* 80 (8), T244 (1979)). The paper side layer fabric of the test fabric has a much shorter frame length than the conventional fabric, indicating that it should provide superior fiber retention.

Handsheets made using repulped computer paper and having a basis weight of about 26 g/m$^2$, were formed on both the conventional and test fabrics using a gravity apparatus which induces machine direction orientation in the deposited fibers. The resulting hand sheets were visually inspected using both transmitted light, and low angle reflected light. When inspected using transmitted light, the handsheets formed on the test fabric exhibited significantly reduced wire mark when compared to the handsheets formed on the conventional fabric. When inspected using low angle reflected light, the handsheets formed on the test fabric appeared to be much smoother than the handsheets formed on the convectional fabric. The observed improvements in increased smoothness and reduced wire mark found with handsheets formed on the test fabric according to this invention can be reasonably expected to provide improved printability properties in comparison with sheets formed on a conventional fabric.

Whilst composite fabrics according to this invention can be woven either as a flat continuous run and then seamed, or as a circular fabric, to provide a forming fabric, it is preferred that a flat continuous weave is used.

What is claimed is:

1. A composite forming fabric comprising in combination a paper side layer having a paper side surface, a machine side layer, and a plurality of pairs of first and second members which together comprise pairs of intrinsic weft binder yarns which bind together the paper side layer and the machine side layer, wherein:

(i) the paper side layer and the machine side layer each comprise warp yarns and weft yarns woven together in a repeating pattern, and the paper side layer and the machine side layer together are woven in at least 12 sheds;

(ii) in the paper side surface of the paper side layer the repeating pattern provides a weft yarn path in which the paper side layer weft yarn floats over 1, 2 or 3 consecutive paper side layer warp yarns;

(iii) each of the pairs of intrinsic weft binder yarns occupy one unbroken weft path in the paper side layer;

(iv) in the paper side layer the weave pattern of the unbroken weft path occupied by a pair of intrinsic weft binder yarns is the same, or different, to the weave pattern of the weft path occupied by the immediately adjacent paper side layer weft yarns; and (v) the number of warp yarns in the paper side layer is equal to the number of warp yarns in the machine side layer; and wherein the pairs of intrinsic weft binder yarns are woven such that:

(a) in a first segment of the unbroken weft path:

(1) the first member of the pair interweaves with a first group of warps to occupy a first part of the unbroken weft path in the paper side surface of the paper side layer;

(2) the first member of the pair floats over 1, 2 or 3 consecutive paper side layer warp yarns; and (3) the second member of the pair interweaves with at least one warp yarn in the machine side layer;

(b) in an immediately following second segment of the unbroken weft path:

(1) the second member of the pair interweaves with a second group of warps to occupy a second part of the unbroken weft path in the paper side surface of the paper side layer;

(2) the second member of the pair floats over 1, 2 or 3 consecutive paper side layer warp yarns; and (3) the first member of the pair interweave with at least one warp yarn in the machine side layer;

(c) the first and second segments are of equal or unequal length;

(d) the unbroken weft path in the paper side surface of the paper side layer occupied in turn by the first and the second member of each pair of intrinsic weft binder yarns in the paper side layer has a single repeat pattern; and (e) in the unbroken weft path in the paper side surface of the paper side layer occupied in turn by the first and second members of each pair of intrinsic weft binder yarns, each succeeding segment is separated in the paper side surface of the paper side layer by at least one paper side layer warp yarn.

2. A composite forming fabric according to claim 1 wherein in the unbroken weft path in the paper side surface of the paper side layer occupied in turn by the first and second members of each pair of intrinsic weft binder yarns, each succeeding segment is separated in the paper side surface of the paper side layer either by one paper side layer warp yarn, or by two paper side layer warp yarns.

3. A composite forming fabric according to claim 1 wherein either:

(a) the unbroken weft path repeat pattern is in registration with at least one adjacent weft yarn; or (b) the unbroken weft path repeat pattern is not in registration with at least one adjacent weft yarn; or (c) both the weft yarns and the unbroken weft path are woven to the same pattern, and are in registration with each other; or (d) both of the adjacent weft yarns are woven to the same pattern and in registration with each other, and the unbroken weft path is woven to a different pattern.

4. A composite forming fabric according to claim 1 wherein either:

(a) both the adjacent weft yarns are woven to the same pattern but not in registration with each other, and the unbroken weft path is woven to the same pattern and in registration with one of the adjacent weft yarns; or (b) both the adjacent weft yarns are woven to the same pattern but not in registration with each other, and the unbroken weft path is woven to a different pattern.

5. A composite forming fabric according to claim 1 wherein either:

(a) the segment lengths are equal, and the weft binder pair members are interwoven according to a repeating pattern that is in registration with that of the paper side layer weave; or (b) the segment lengths are equal, and the weft binder pair members are interwoven according to a repeating pattern that is not in registration with that of the paper side layer weave; or (c) the segment lengths are unequal, and the weft binder pair members are interwoven according to a repeating pattern that is in registration with that of the paper side layer weave; or (d) the segment lengths are unequal, and the pair members are interwoven according to a repeating pattern that is not in registration with that of the paper side layer weave.

6. A composite forming fabric according to claim 1 wherein the locations at which the members of the intrinsic weft binder yarn pairs interweave with the machine side layer warp yarns are spaced a constant distance apart along the machine side layer warp yarns in the machine side layer weave structure.

7. A composite forming fabric according to claim 1 wherein the locations at which the members of the intrinsic weft binder yarn pairs interweave with the machine side layer warp yarns are spaced a constant distance apart along the machine side layer warp yarns in the machine side layer weave structure, and there are the same number of paper side layer wefts between each pair of intrinsic weft binder yarns.

8. A composite forming fabric according to claim 1 wherein the weave construction of the paper side layer is selected from the group consisting of: plain weave, 2/1 twill, 3/1 twill, 3/1 broken twill, and 2×2 basket weave.

9. A composite forming fabric according to claim 1 wherein the weave construction of the machine side layer woven structure is selected from the group consisting of: a four-shed twill weave, a four-shed broken twill weave, a four-shed/eight repeat satin weave, a 5-shed satin weave, an eight-shed/eight repeat satin weave having differing warp and weft float lengths within one repeat of the weave pattern, and single layer n×2n weave patterns in which the warp yarns form two distinct floats of unequal length, and the weft yarns form floats of equal or unequal length on the machine side surface.

10. A composite forming fabric according to claim 1 wherein the weave construction of the unbroken weft path for the intrinsic weft binder yarns corresponds to a weft path in a weave construction selected from the group consisting of: plain weave, 2/1 twill, 3/1 twill, and 2×2 basket weave, in which there are at most two intervening paper side layer warps at the interchange points at the segment ends.

11. A composite forming fabric according to claim 1 wherein the ratio of the number of paper side layer weft yarns, including allowing for pairs of intrinsic weft binder yarns, to the number of weft yarns in the machine side layer, is at least 3:2.

12. A composite forming fabric according to claim 1 wherein the ratio of the number of paper side layer weft yarns, including allowing for pairs of intrinsic weft binder yarns, to the number of weft yarns in the machine side layer, is chosen from a value in the range of from at least 3:2 to 5:1.

13. A composite forming fabric according to claim 1 wherein the diameter of the weft binder pair yarn is either at least the same as, or marginally larger than, the diameter of the paper side layer weft yarn.

14. A composite forming fabric comprising in combination a paper side layer having a paper side surface, a machine side layer, and a plurality of pairs of first and second members which together comprise pairs of intrinsic weft binder yarns which bind together the paper side layer and the machine side layer, wherein:

(i) the paper side layer and the machine side layer each comprise warp yarns and weft yarns woven together in a repeating pattern, and the paper side layer and the machine side layer together are woven in at least 12 sheds;

(ii) in the paper side surface of the paper side layer the repeating pattern provides a weft yarn path in which the weft yarn floats over 1, 2 or 3 consecutive paper side layer warp yarns;

(iii) each of the pairs of intrinsic weft binder yarns occupy one unbroken weft path in the paper side layer;

(iv) in the paper side layer the weave pattern of the unbroken weft path occupied by a pair of intrinsic weft binder yarns is the same, or different, to the weave pattern of the weft path occupied by the immediately adjacent paper side layer weft yarns; and (v) the number of warp yarns in the paper side layer is equal to the number of warp yarns in the machine side layer;

and wherein the pairs of intrinsic weft binder yarns are woven such that:

(a) in a first segment of the unbroken weft path:

(1) the first member of the pair interweaves with a first group of warps to occupy a first part of the unbroken weft path in the paper side surface of the paper side layer that is substantially identical to that of its adjacent paper side layer wefts; and (2) the second member of the pair interweaves with at least one warp yarn in the machine side layer;

(b) in an immediately following second segment of the broken weft path:

(1) the second member of the pair interweaves with a second group of warps to occupy a second part of the unbroken weft path in the paper side surface of the paper side layer that is substantially identical to that of its adjacent paper side layer wefts; and (2) the first member of the pair interweaves with at least one warp yarn in the machine side layer;

(c) the first and second segments are the same length;

(d) the unbroken weft path in the paper side surface of the paper side layer occupied in turn by the first and the second member of each pair of intrinsic weft binder yarns in the paper side layer has a single repeat pattern; and (e) in the unbroken weft path in the paper side surface of the paper side layer occupied in turn by the first and second members of each pair of intrinsic weft binder yarns, each succeeding segment is separated in the paper side surface of the paper side layer by at least one paper side layer warp yarn.

15. A composite forming fabric according to claim 14 wherein either:

(a) the unbroken weft path repeat pattern is in registration with at least one adjacent weft yarn; or (b) the unbroken weft path repeat pattern is in registration with both adjacent weft yarns; or (c) the unbroken weft path repeat pattern is not in registration with at least one adjacent weft yarn.

16. A composite forming fabric according to claim 14 wherein the locations at which the members of the intrinsic weft binder yarn pairs interweave with the machine side layer warp yarns are spaced a constant distance apart along the machine side layer warp yarns in the machine side layer weave structure.

17. A composite forming fabric according to claim 14 wherein the locations at which the members of the intrinsic weft binder yarn pairs interweave with the machine side layer warp yarns are spaced a constant distance apart along the machine side layer warp yarns in the machine side layer weave structure, and there are the same number of paper side layer wefts between each pair of intrinsic weft binder yarns.

18. A composite forming fabric according to claim 14 wherein the weave construction of the paper side layer is selected from the group consisting of: plain weave, 2/1 twill, 3/1 twill, 3/1 broken twill, and 2×2 basket weave.

19. A composite forming fabric according to claim 14 wherein the weave construction of the machine side layer woven structure is selected from the group consisting of: a four-shed twill weave, a four-shed broken twill weave, a four-shed/eight repeat satin weave, a 5-shed satin weave, an eight-shed/eight repeat satin weave having differing warp and weft float lengths within one repeat of the weave pattern, and single layer n×2n weave patterns in which the warp yarns form two distinct floats of unequal length, and the weft yarns form floats of equal or unequal length on the machine side surfaces.

20. A composite forming fabric according to claim 14 wherein the weave construction of the unbroken weft path for the intrinsic weft binder yarns corresponds to a weft path in a weave construction selected from the group consisting of: plain weave, 2/1 twill, and 3/1 twill.

21. A composite forming fabric according to claim 14 wherein the ratio of the number of paper side layer weft yarns, including allowing for pairs of intrinsic weft binder yarns, to the number of weft yarns in the machine side layer, is at least 3:2.

22. A composite forming fabric according to claim 14 wherein the ratio of the number of paper side layer weft yarns, including allowing for pairs of intrinsic weft binder yarns, to the number of weft yarns in the machine side layer, is chosen from a value in the range of from at least 3:2 to 5:1.

23. A composite forming fabric according to claim 14 wherein the diameter of the weft binder pair yarn is either at least the same as, or marginally larger than, the diameter of the paper side layer weft yarn.

* * * * *